US007178629B2

(12) United States Patent
Vincenot

(10) Patent No.: US 7,178,629 B2
(45) Date of Patent: Feb. 20, 2007

(54) ELECTROACOUSTIC PUBLIC ADDRESS UNIT WITH ACOUSTIC HORN OR WAVEGUIDE

(75) Inventor: Eric Vincenot, Paris (FR)

(73) Assignee: NEXO, Villepinte (FR)

( * ) Notice: Subject to any disclaimer, the term of this patent is extended or adjusted under 35 U.S.C. 154(b) by 406 days.

(21) Appl. No.: 10/484,465

(22) PCT Filed: Jul. 22, 2002

(86) PCT No.: PCT/FR02/02616

§ 371 (c)(1),
(2), (4) Date: Jan. 22, 2004

(87) PCT Pub. No.: WO03/013184

PCT Pub. Date: Feb. 13, 2003

(65) Prior Publication Data

US 2004/0206572 A1 Oct. 21, 2004

(30) Foreign Application Priority Data

Jul. 23, 2001 (FR) ..... 01/09798

(51) Int. Cl.

| | |
|---|---|
| ***G10K 11/26*** | (2006.01) |
| ***H04R 1/28*** | (2006.01) |
| ***H04R 1/30*** | (2006.01) |
| ***H04R 1/34*** | (2006.01) |
| *G10K 11/18* | (2006.01) |
| *H04R 1/20* | (2006.01) |

(52) U.S. Cl. ..... 181/191; 181/185; 181/186; 381/337; 381/339; 381/340; 381/387

(58) Field of Classification Search ..... 181/191, 181/185, 186; 381/339, 340, 387
See application file for complete search history.

(56) References Cited

U.S. PATENT DOCUMENTS

| | | | | | |
|---|---|---|---|---|---|
| 272,866 | A | * | 2/1883 | Drawbaugh | 381/342 |
| 982,732 | A | * | 1/1911 | Lehnert | 181/185 |
| 1,352,291 | A | * | 9/1920 | Long | 181/183 |
| 1,438,712 | A | * | 12/1922 | Mosmann | 181/186 |
| 1,661,525 | A | * | 3/1928 | Deerfoot | 181/185 |
| 1,729,336 | A | * | 9/1929 | France | 84/400 |
| 2,621,553 | A | * | 12/1952 | Daoust | 84/400 |
| 4,178,829 | A | * | 12/1979 | Wolford | 84/386 |
| 4,628,155 | A | | 12/1986 | Robineau et al. | |
| 4,685,532 | A | * | 8/1987 | Gunness | 181/185 |
| 5,020,630 | A | | 6/1991 | Gunness | |
| 5,398,992 | A | * | 3/1995 | Daniels | 297/217.4 |
| 6,112,847 | A | | 9/2000 | Lehman | |
| 6,394,223 | B1 | * | 5/2002 | Lehman | 181/152 |

FOREIGN PATENT DOCUMENTS

| | | | |
|---|---|---|---|
| FR | 1 079 073 | | 11/1954 |
| JP | 55165097 | A * | 12/1980 |
| JP | 60052196 | A * | 3/1985 |

* cited by examiner

*Primary Examiner*—Edgardo San Martin
(74) *Attorney, Agent, or Firm*—Young & Thompson

(57) ABSTRACT

A horn or waveguide public address unit, enabling to adapt the dispersion characteristics of the horn or waveguide. The unit is provided with at least one profiling component (21*a*, 21*b*) constituting a removable dispersion shaper, capable of being mounted on the inner wall of the horn (13) or waveguide between the throat (17) and the mouth (19) thereof.

14 Claims, 3 Drawing Sheets

FIG. 2
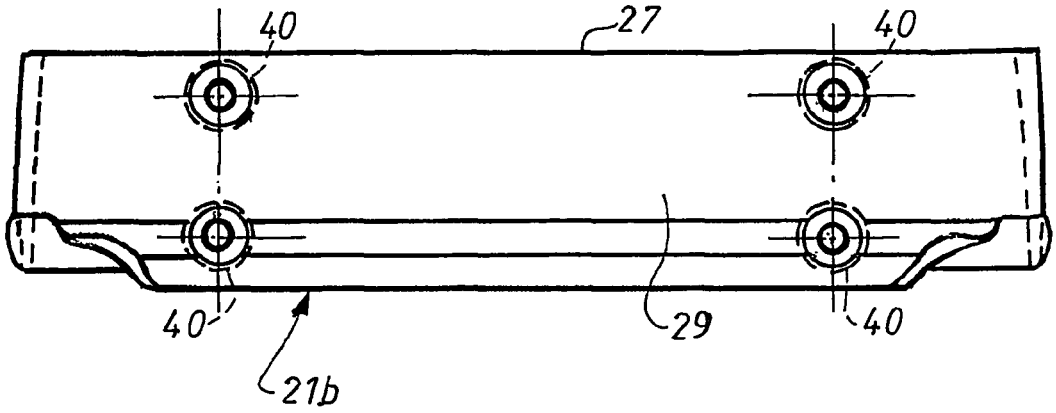
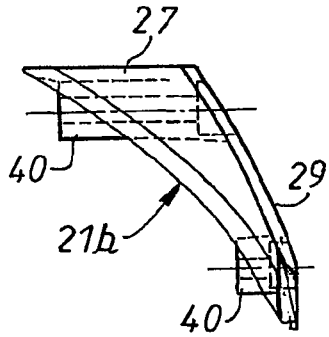
FIG. 3
FIG. 4
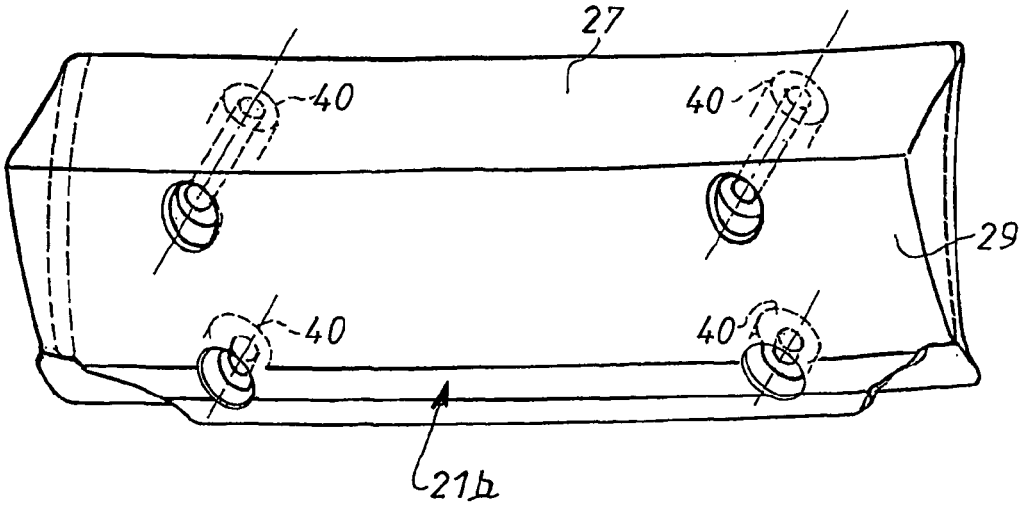

FIG. 5
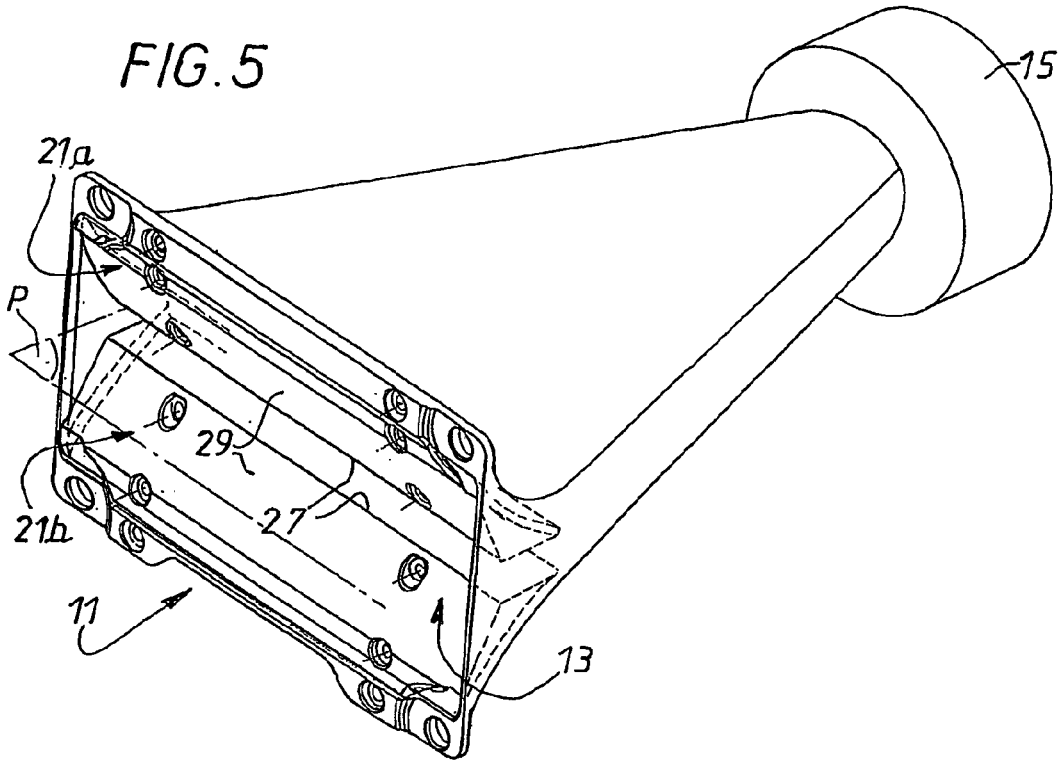
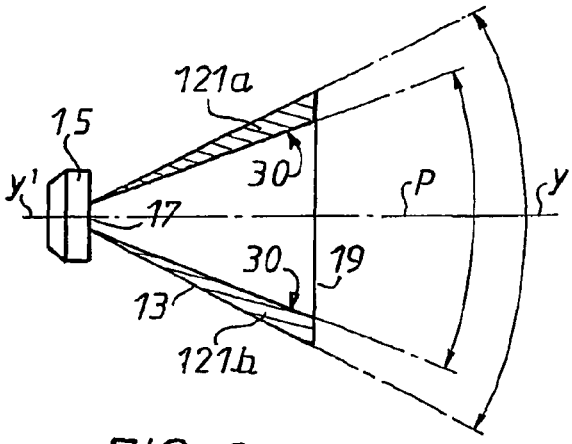
FIG. 6
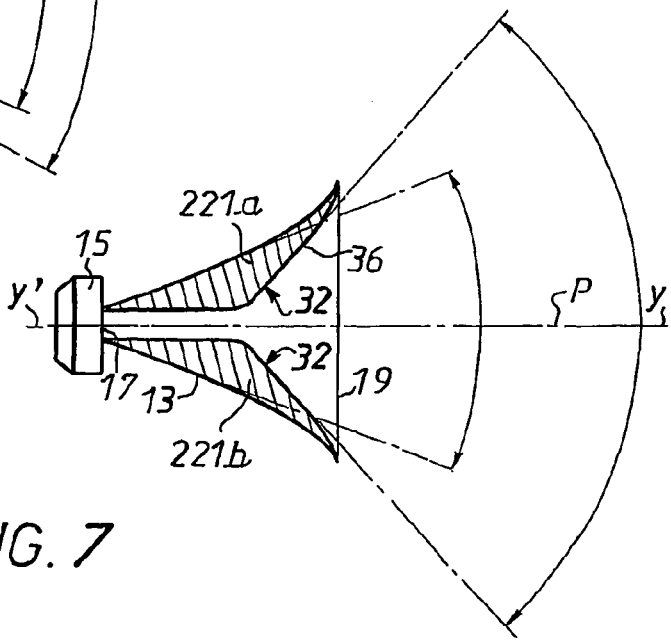
FIG. 7

ELECTROACOUSTIC PUBLIC ADDRESS UNIT WITH ACOUSTIC HORN OR WAVEGUIDE

FIELD OF THE INVENTION

The invention relates to an electroacoustic sound reinforcement unit with a horn or an acoustic waveguide. It relates more particularly to an improvement for adapting the dispersion characteristic of said horn or waveguide as a function of the configuration of the site in which said sound reinforcement unit is installed.

BACKGROUND OF THE INVENTION

Electroacoustic sound reinforcement units with an acoustic horn or waveguide are often used in sound reinforcement systems for use out of doors or in large rooms. These sound reinforcement units are more particularly suitable for reproducing medium and high frequencies. A horn or acoustic waveguide is defined between a throat, to which an electroacoustic transducer (i.e. a loudspeaker or a compression chamber driver) is connected, and a mouth, from which the sound propagates into the exterior medium. The shape of the horn or waveguide can be characterized by a function defining the expansion of its cross section between the throat and the mouth, i.e. the variation of said cross section along a defined propagation axis between said throat and said mouth. The function can be linear, exponential or otherwise. It is generally an increasing function between the throat and the mouth. The three parameters previously cited, namely the area of the throat, that of the mouth, and the expansion function, determine the dispersion of the acoustic wave at the exit of the horn or waveguide. As a general rule, dispersion increases with expansion. At low frequencies, dispersion control improves as the area of the mouth increases and at high frequencies dispersion control improves as the area of the throat decreases.

The optimum dispersion characteristics vary with the configuration of the sound reinforcement site. An important part of the know-how of sound engineers therefore consists in choosing sound reinforcement units with the most suitable dispersion characteristics. They must therefore have available a large number of sound reinforcement units with entirely different characteristics, in particular different horn or acoustic waveguide shapes and dimensions. The invention overcomes this drawback. The basic idea of the invention is that the same sound reinforcement unit can have its dispersion characteristics adapted by modifying one or more of the parameters defined hereinabove and in particular the expansion function of the horn or waveguide.

SUMMARY OF THE INVENTION

To this end, the invention consists in an electroacoustic sound reinforcement unit having a horn or an acoustic waveguide defined between a throat to which an electroacoustic transducer is connected and a mouth from which sound propagates into the external medium, characterized in that it includes at least one profiling member that constitutes a removable dispersion shaping member and is shaped to be mounted on the inside wall of said horn or waveguide between said throat and said mouth to modify the interior shape of said horn or waveguide.

The profiling member can be a variable profile conduit defining the new expansion function. It is inserted into and fixed inside the horn or acoustic waveguide. In a preferred embodiment, there are two profiling members that can be fitted to two opposite interior walls of the horn or waveguide.

A profiling member of the above kind or a set of profiling members as defined above therefore changes the dispersion characteristic of the sound reinforcement unit, which may also be associated with a plurality of profiling members or sets of profiling members chosen by the technician to optimize the dispersion characteristic as a function of the configuration of the operating site.

For example, for a sound reinforcement unit of the type comprising a horn or waveguide having a plane of symmetry extending between the throat and the mouth, two of the profiling members previously cited could be fixed to the inside wall of the horn or waveguide, symmetrically to each other, and attached to said inside wall at locations such that said plane of symmetry is preserved.

Various shapes of the profiling members are described hereinafter.

A sound reinforcement unit of the invention, i.e. at least adapted to receive one or more profiling members as defined above, is therefore characterized in that said horn or waveguide includes means for fixing at least one profiling member constituting a dispersion adapter. For example, assembly means of the nut and bolt type or using adhesive or magnetic members may be used.

BRIEF DESCRIPTION OF THE DRAWINGS

The invention will be better understood and other advantages of the invention will become more clearly apparent in the light of the following description, which is given by way of example only and with reference to the appended drawings, in which:

FIG. 2 is a front view of one of the profiling members;

FIG. 3 is a profile view of the same member;

FIG. 4 is a perspective view of the same member;

FIG. 5 is a perspective view similar to FIG. 1 showing the two profiling members in place inside the horn; and FIGS. 6 and 7 are diagrams of variants.

DETAILED DESCRIPTION OF THE PREFERRED EMBODIMENTS

Figure 1:
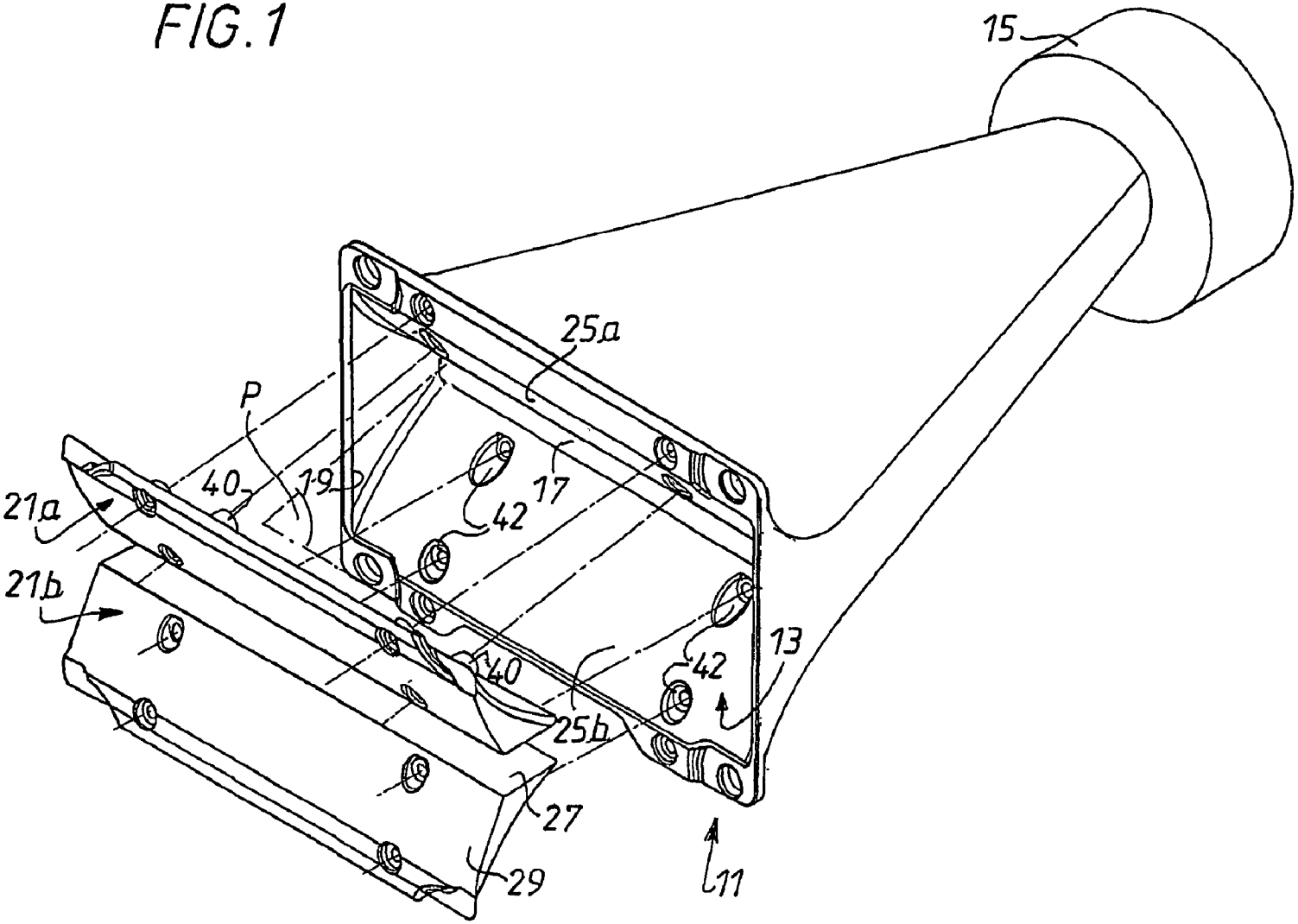
FIG. 1 is a diagrammatic exploded perspective view of a horn sound reinforcement unit in the field of the invention equipped with two complementary profiling members for modifying its intrinsic acoustic dispersion characteristics.

FIGS. 1 to 5 show an electroacoustic sound reinforcement unit 11 with a horn 13, which here is relatively rigid, comprising an electroacoustic transducer 15, or acoustic generator as it is otherwise known, connected to a small section opening 17 called the throat defined at the back of the horn. The horn 13 is fixed relative to the transducer 15. The inside wall of the horn widens to a mouth 19, which here is approximately rectangular, from which sound propagates into the exterior medium. A sound propagation axis can be defined passing through the center of the throat and through the center of the mouth. A propagation axis y'y of this kind is shown diagrammatically in FIGS. 6 and 7. The variation of the cross section of the horn along this axis represents the expansion function defined above. As such, the horn therefore has a given expansion function, depending only on the shape and the dimensions of its inside surface. This expansion function constitutes one of the parameters conditioning the dispersion characteristics of the horn (or the acoustic waveguide if the electroacoustic transducer is not connected to a horn as shown here).

According to an important feature of the invention, the sound reinforcement unit is completed by at least one profiling member 21 constituting a dispersion adapter and shaped to be mounted on the inside wall of the horn or waveguide, between the throat 17 and the mouth 19. By inserting and fixing one or more profiling members of this type into the horn, the interior shape of the horn or waveguide, and consequently its dispersion characteristics, can be adapted as a function of the configuration of the operating site. In the present example, two profiling members 21*a*, 21*b* are used, and are adapted to be fitted to respective similar opposite faces 25*a*, 25*b* of said inside wall of said horn. In the example shown, said horn has a plane of symmetry P extending between the throat and the mouth. The two profiling members 21*a*, 21*b* are symmetrical and can be fitted to the two faces 25*a*, 25*b*, respectively, at locations such that said plane of symmetry P is preserved. In other words, the plane of symmetry P of the inside wall of the horn, as seen in FIG. 1, remains the plane of symmetry of the inside wall of the modified horn, i.e. when the latter incorporates the two profiling members 21*a*, 21*b*, as shown in FIG. 5.

In the present example, each profiling member has a first guide surface 27 substantially parallel to the plane of symmetry P when the profiling member is fitted and a second guide surface 29 extending said first drive surface and defining therewith an approximately obtuse dihedron. Said second guide surface is nevertheless very slightly curved.

In the example shown diagrammatically in FIG. 6, each profiling member 121*a*, 121*b* has a guide plane 30 inclined to a plane surface of the inside wall 13 of the horn. The guide plane and the plane surface join in the vicinity of the throat 17. On the other hand, in the FIG. 7 variant, each profiling member 221*a*, 221*b* has a curved profile guide surface 32 with a throat portion 34 substantially parallel to said plane of symmetry, in the immediate vicinity of the throat 17 of the horn, and a mouth portion 36 diverging from the plane of symmetry, starting from the throat portion. The two portions 34, 36 join together with no discontinuity.

Different solutions can be envisaged for fixing the profiling members to the wall of the horn. In the example of FIGS. 1 to 5, the horn 13 (or waveguide), on the one hand, and the or each profiling member 21*a*, 21*b*, on the other hand, includes nut and bolt type assembly means. Consequently, holes formed in the wall of the horn or in each profiling member can have threaded portions or portions equipped with captive nuts. The holes in the profiling members are here formed in columns 40 that engage in holes 42 of the wall of the horn. If the nuts are attached to the horn, the heads of the bolts bear on shoulders formed inside holes formed in the profiling members.

Alternatively, the horn (or waveguide), on the one hand, and/or the or each profiling member, on the other hand, can include adhesive assembly means, for example double-sided adhesive tapes.

Another alternative is for said horn (or waveguide), on the one hand, and/or the or each profiling member, on the other hand, to include assembly means employing magnetic members. For example, if the horn is made from a metal with magnetic properties (iron, steel), the profiling members can be fitted with magnetized pads. The converse arrangement is possible. The horn and the profiling members could also be fitted with magnetized pads cooperating in pairs.

As can be seen in FIGS. 5 to 7, placing the profiling members inside the horn modifies its expansion function by defining a new inside surface of the horn that is substituted for the original surface. This modification of the expansion function adapts the dispersion characteristic of the sound reinforcement unit. Of course, any sound reinforcement unit with a horn or waveguide defined between a throat to which an electroacoustic transducer is connected and a mouth from which sound propagates into the external medium lies within the field of the invention provided that said horn or waveguide connected to said transducer is provided with means for fixing at least one profiling member constituting a dispersion adapter.

The invention claimed is:

1. An electroacoustic sound reinforcement unit comprising a horn or acoustic waveguide disposed between a throat connected to an electroacoustic transducer and a sound propagating mouth through which sound is propagated into an external medium, at least one dispersion shaping profiling member removably mounted on an inside wall of the horn or waveguide for modifying the interior shape of the horn or waveguide and the dispersion characteristic thereof, whereby the horn or waveguide has a first dispersion characteristic when the at least one profiling member is mounted in position on the inside wall and a second dispersion characteristic when the at least one profiling member is not mounted in position on the inside wall.

2. A sound reinforcement unit according to claim 1, wherein two said dispersion shaping profiling members are adapted to be fitted to respective opposite faces of said inside wall of the horn or waveguide.

3. A sound reinforcement unit according to claim 2, wherein the horn or waveguide has a plane of symmetry extending between said throat and said mouth, two said dispersion shaping profiling members being symmetrical and removably mounted on respective opposite faces at locations such that symmetry between the throat and mouth is preserved.

4. A sound reinforcement unit according to claim 3, wherein the at least one dispersion shaping profiling member has a guide plane inclined relative to a plane surface of said inside wall, said guide plane and said plane surface meeting in the vicinity of said throat.

5. A sound reinforcement unit according to claim 2, wherein the at least one dispersion shaping profiling member has a first guide surface substantially parallel to said plane of symmetry and extended by a second guide surface defining an approximately obtuse dihedron with said first guide surface.

6. A sound reinforcement unit according to claim 3, wherein the at least one dispersion shaping profiling member has a curved profile guide surface comprising a throat portion substantially parallel to said plane of symmetry and extended by a mouth portion diverging from said plane of symmetry, starting from said throat portion.

7. A sound reinforcement unit according to claim 1, further comprising at least one bolt for removably mounting the at least dispersion shaping profiling member on the horn or waveguide.

8. A sound reinforcement unit according to claim 1, further comprising an adhesive for removably mounting the at least one dispersion shaping profiling member on the horn or waveguide.

9. A sound reinforcement unit according to claim 1, further comprising at least one magnetic member for removably mounting the at least one dispersion shaping profiling member on the horn or waveguide.

10. A sound reinforcement unit according to claim 1, further comprising a mechanical fastener for removably mounting the at least one dispersion shaping profiling member on the horn or waveguide.

11. A sound reinforcement unit comprising a horn or an acoustic waveguide extending between a throat at which is connected an electroacoustic transducer and a sound propagating mouth through which sound is propagated into an external medium, means for removably mounting at least one dispersion shaping profiling member on the horn or waveguide.

12. A sound reinforcement unit according to claim 11, wherein said means for removably mounting on the horn or waveguide comprises an adhesive.

13. A sound reinforcement unit according to claim 11, wherein said means for removably mounting on the horn or waveguide comprises at least one magnetic member.

14. A sound reinforcement unit according to claim 11, wherein said means for removably mounting on the horn or waveguide comprises at least one adhesive member.

* * * * *